US006206427B1

(12) United States Patent
Kremer

(10) Patent No.: US 6,206,427 B1
(45) Date of Patent: Mar. 27, 2001

(54) BOOK

(75) Inventor: Thomas Kremer, London (GB)

(73) Assignee: Seven Towns Limited, London (GB)

( * ) Notice: Subject to any disclaimer, the term of this patent is extended or adjusted under 35 U.S.C. 154(b) by 0 days.

(21) Appl. No.: 09/383,093

(22) Filed: Aug. 25, 1999

(30) Foreign Application Priority Data

Aug. 28, 1998 (GB) ..... 9818544

(51) Int. Cl.[7] ..... A63H 3/00; A63H 33/38; B42D 1/00

(52) U.S. Cl. ..... 281/51; 281/15.1; 281/38; 283/117

(58) Field of Search ..... 281/15.1, 38, 51; 283/117

(56) References Cited

U.S. PATENT DOCUMENTS

D. 38,643 6/1907 Garman .
4,819,963 4/1989 Wolski .
4,909,542 * 3/1990 Marks ..... 281/15.1
5,096,204 3/1992 Lippman .
5,833,509 * 11/1998 Hunt ..... 281/15.1
5,901,983 * 5/1999 Bini ..... 281/38

OTHER PUBLICATIONS

Abstract of U.S. Design patent 356,605.

* cited by examiner

*Primary Examiner*—A. L. Wellington
*Assistant Examiner*—Mark T. Henderson
(74) *Attorney, Agent, or Firm*—Baker Botts L.L.P.

(57) ABSTRACT

A book which comprises:

first and second rigid covers, a plurality of rigid pages, and binding means attached to an edge of each rigid cover and each rigid page, wherein at least some of said rigid pages are of a different size to others of such rigid pages so that when said book is closed, said plurality of pages is sandwiched between said first and second covers to form a three-dimensional sculpture.

8 Claims, 2 Drawing Sheets

BOOK

FIELD OF THE INVENTION

This invention relates to a book.

BACKGROUND OF THE INVENTION

U.S. Pat. No. 4,819,963 describes a book which has covers which, when closed, form the shape of a fish. All the pages are the are shape and fit between the covers.

The number of shapes in which a book as described in U.S. Pat. No. 4,819,963 can be made is limited.

An object of the present invention is to increase the choice of shapes in which a book can be made.

SUMMARY OF THIS INVENTION

According to the present invention, there is provided a book, which comprises first and second rigid covers, a plurality of rigid pages, and binding means attached to an edge of each rigid cover and each rigid page, wherein at least some of said rigid pages are of a different size to others of said rigid pages so that when said book is closed said plurality of rigid, pages is sandwiched between said first and second covers to form a three-dimensional sculpture.

By varying the sizes of the pages a complex three-dimension sculpture can be formed.

Preferably the covers and the pages each have an edge which together define a planar surface to which said binding means are attached. This construction helps ensure that a secure binding can be obtained.

Advantageously, at least some of the pages comprise a disc having a projection which extends outwardly from the disc and has an edge which forms part of the planar surface to which the binding means is attached.

Preferably, one of said covers forms a base upon which the book can stably stand when closed. The base could take any suitable form, for example a stand, a foot or a pair of feet.

Advantageously, the other of said covers forms a top, for example a hat.

In one embodiment a side projection extends outwardly from at least one of said pages. Such a side projection may conveniently take the form of an arm. If desired, two or more side projections may be provided which extend from the same or different pages. Conveniently, the side projections are attached, for example adhered, to their associated pages although they could conceivably be formed as an integral part thereof.

Preferably, said first and second covers and said plurality of pages are made from plastic.

Advantageously, said pages have a thickness of at least 1 mm, preferably at least 2 mm, and advantageously at least 3 mm.

Preferably, at least some of the said pages have images applied thereto. Such images may be applied directly or may be formed by applying transfers or adhering printed matter to said pages.

For a better understanding of the present invention reference will now be made, by way of example, to the accompanying drawings in which:

DETAILED DESCRIPTION OF THE PREFERRED EMBODIMENT

Figure 1:
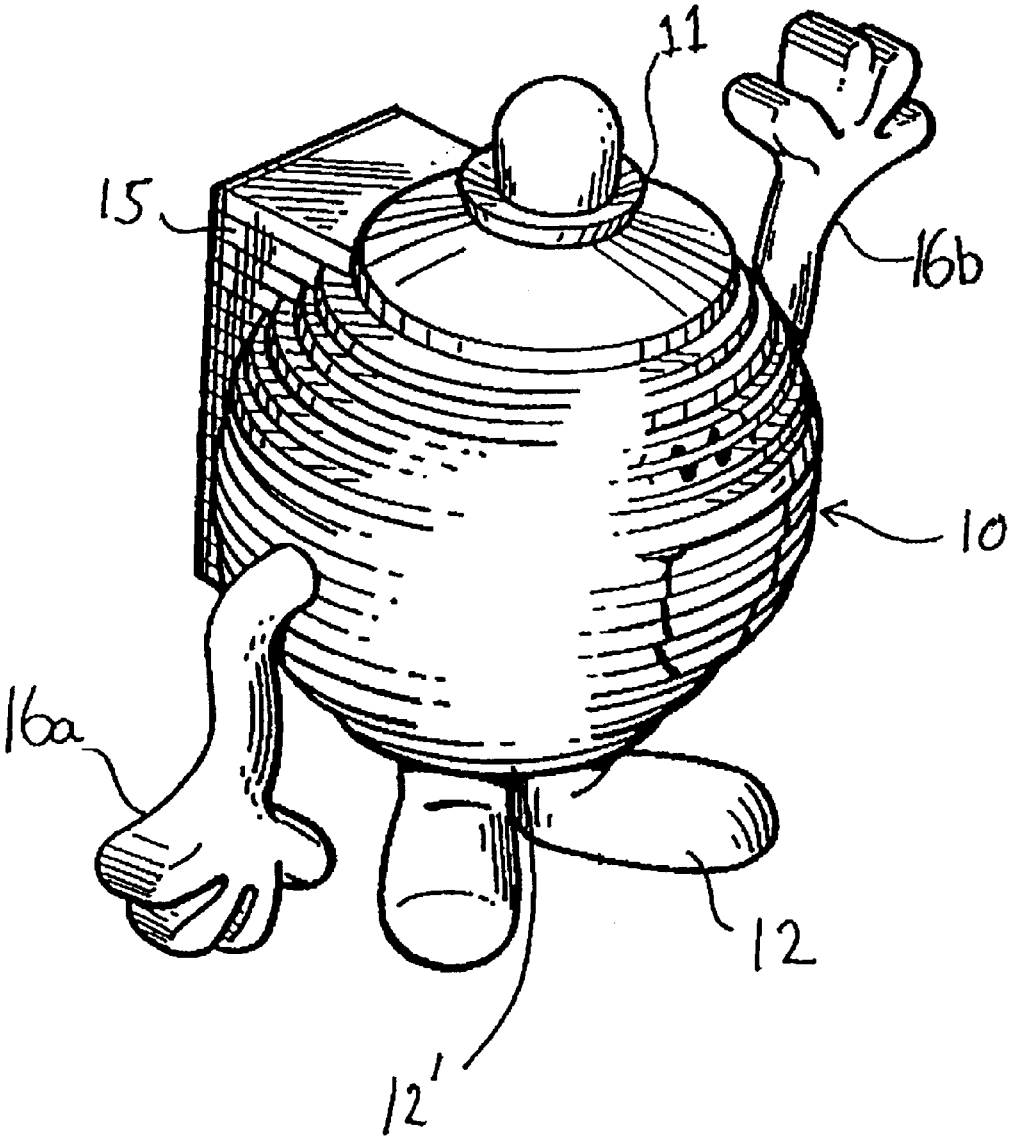
FIG. 1 shows a perspective view of one embodiment of a book according to the present invention in a closed state.
Figure 3:
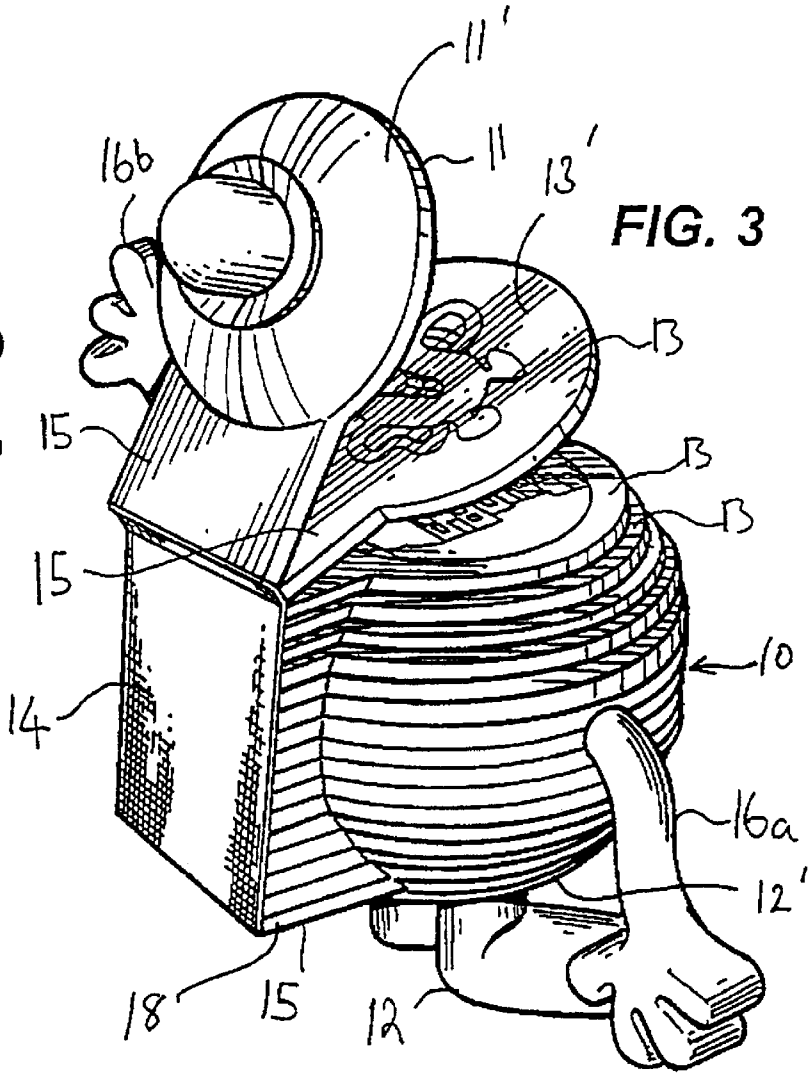
FIG. 3 shows the book in a second partially open state.
Figure 2:
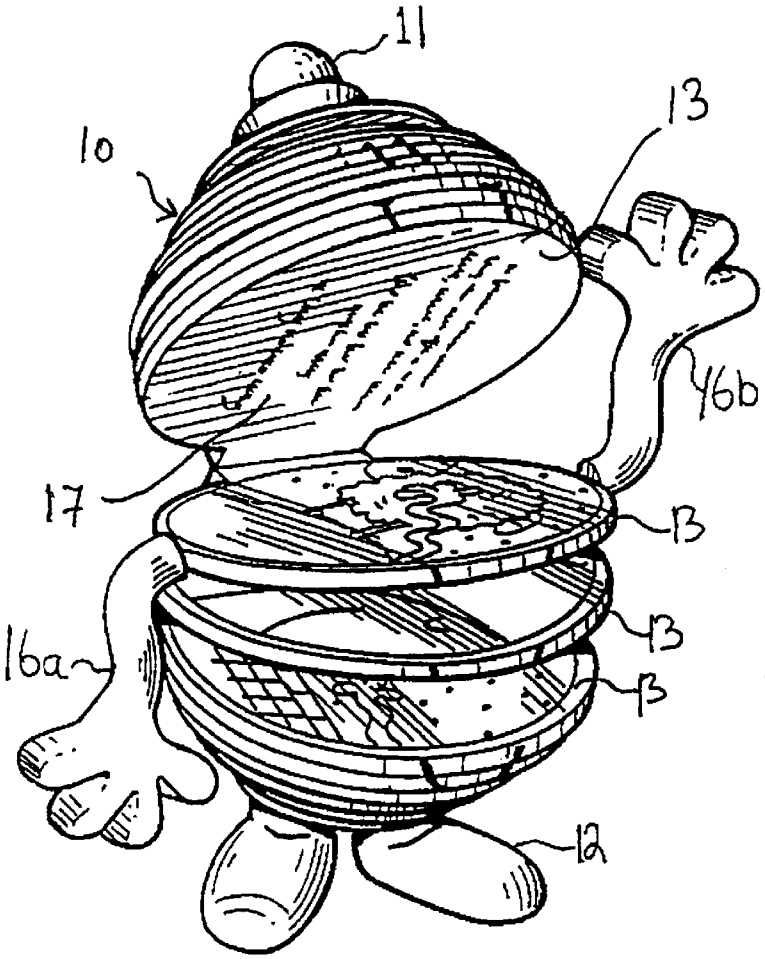
FIG. 2 shows the book in a front partially open state.

Referring to FIGS. 1 to 3 there is shown a book which is generally identified by reference number 10. The book 10, which generally resembles a "Mr Man", comprises a top 11, a base 12 and sixteen pages 13 (seen most clearly in FIGS. 2 and 3). Each of the pages 13 comprises a substantially circular disc 13' with a projection 15 (best seen in FIG. 3) which lies in the plane of the disc 13' and extends away from the centre of the disc 13'. Each page 13 is made of plastics material and is three millimeters thick.

The top 11 comprises a substantially circular disc 11' with a projection which lies in the plane of the disc 11' and extends away from the centre of the disc 11'. The top 11 has a lower surface which is flat. The upper surface of the circular disc 11' is shaped to form the hat of the "Mr Man".

The base 12 comprises a substantially circular disc 12' with a projection 15 which lies in the plane of the circular disc 12' and extends away from the centre of the circular disc 12'. The base 12 has an upper surface which is flat. The bottom surface of the circular disc 12' is shaped to form two feet for the "Mr Man" which also acts as a pedestal on which the book 10 can stand.

The projections 15 on the top 11, base 12 and pages 13 are such that, when the pages 13 are stacked between the base 12 and the top 11, a planar edge surface 18 is formed by the edges of the projections 15 of the top 11, base 12, and pages 13.

A binding material 14 is attached to the planar edge surface 18 formed by the projections 15 to form the spine of the book. The binding material 14 is a piece of fabric which is glued to the planar edge surface 18.

Thus, when the book is closed, the pages 13 form the body of the "Mr Man".

The top 11, base 12 and pages 13 are made from plastics material which has the advantage of making the book 10 rigid, robust and waterproof. This is a particularly advantageous feature as the book 10 is designed for use by a child.

The rigid nature of the pages 13 enables two side projections 16*a,* 16*b,* forming the arms of the toy character, to be attached to one of the pages 13, as shown most clearly in FIG. 2. The two side projections 16*a,* 16*b* project away and out of the plane of the pages 13 to which they are attached. The projection 16*a* and 16*b* are attached to the page 13 using an adhesive.

Printed images 17 are formed on adhesive paper which is attached to the pages 13 of the book 10. This has the advantage that the writing can be printed on the adhesive paper before the adhesive paper is attached to the book.

It will be noted that the disc 13' of the pages 13 are not all the same size. By varying the size and, if necessary, the shape of the discs 13' a complex three-dimensional sculptures can be formed when the book is closed.

A number of modifications can be made to the above-described book without departing from the concept of the invention, for example, it will be appreciated that the particular sculpture of the three-dimensional structure formed when the book is closed does not have to be as shown in the accompanying figures. In fact, the versatility in which books according to the present invention can be shaped allowing many different three-dimensional sculptures be formed is a major advantage of the invention. In particular, the shape of each page need not be circular but may be any other shape, for example oval.

The book may also contain a different number of pages, and these pages may have different thickness compared with the first embodiment. The size of the pages may differ in scale, in outline or in a combination thereof. However, as the book is intended for children, it is preferable that the book contains less than thirty pages and that the thickness of the pages 13 is greater than one millimeter.

While the top 11, base 12 and pages 13 of the preferred embodiment are made using plastics, material, other material such as wood can also be used.

Although in the preferred embodiment two projections 16*a,* 16*b* project away from a single page 13, additional projection could be added and all the projections need not be attached to the same page 13.

Fastening means could be included to hold the book in the closed state as described in U.S. Pat. No. 4,819,963. This would allow the book to be moved around while hold in the closed state.

Although in the preferred embodiment images are written on adhesive paper and the adhesive paper is subsequently attached to the pages 13, the images could be directly written or printed on the pages 13.

STATEMENT OF UTILITY

The invention described above provides a book which, as it can also serve as a toy, can encourage young children to improve their reading skills.

What is claimed is:

1. A book that has the appearance of a standing figure and comprises:

first and second rigid covers, a plurality of rigid pages, at least some of said rigid pages being of a different size to others of such rigid pages so that, when said book is closed and said rigid pages are sandwiched between said first and second covers said pages form a body of a three-dimensional figure, said covers and said pages having respective edges together defining a planar surface, a binder attaching said edges of said rigid covers and each rigid page; and feet which act as pedestals upon which the book can stably stand when closed with the feet as the sole support for the body, said feet being attached directly to the cover under the body in downwardly depending relation.

2. A body according to claim 1, wherein the other of said covers defines a hat.

3. A book according to claim 1, wherein at least some of said pages comprise a disc and a portion which extends outwardly from the disc and terminates at said edge which forms part of said planar surface.

4. A book as claimed in claim 1 which, when closed, has the appearance of a Mr. Man.

5. A book as claimed in claim 1, wherein said first and second covers and said plurality of pages are made from plastics material.

6. A book as claimed in claim 1, wherein said pages have a thickness of at least 3 mm.

7. A book as claimed in claim 1, wherein at least some of the said pages have images applied thereto.

8. A book that has the appearance of a standing figure and comprises:

first and second rigid covers, a plurality of rigid substantially planar pages, at least some of said rigid pages being of a different size to others of such rigid pages so that, when said book is closed and said rigid pages are sandwiched between said first and second covers, said pages form a body of a three-dimensional figure, said covers and said pages having respective edges together defining a planar surface;

a binder attaching said edge of each rigid cover and each rigid page;

feet which act as pedestals upon which the book can stably stand when closed with the feet as the sole support for the body, said feet being attached directly to the cover under the body in downwardly depending relation; and side projections extending outwardly from one of said pages and out of the plane of said page to define arms.

* * * * *